United States Patent [19]

De Boef

[11] Patent Number: 5,020,252

[45] Date of Patent: Jun. 4, 1991

[54] ILLUMINATED SIGN SYSTEM

[76] Inventor: Johannes A. G. De Boef, 121 Jules Verneweg, Tilburg, Netherlands

[21] Appl. No.: 122,475

[22] Filed: Nov. 5, 1987

Related U.S. Application Data

[63] Continuation of Ser. No. 739,935, May 31, 1985, abandoned.

[51] Int. Cl.[5] ..... G09F 13/04

[52] U.S. Cl. ..... 40/564; 362/223; 362/260; 362/349; 362/355

[58] Field of Search ..... 40/564, 570, 574, 572, 40/571, 575, 576, 577, 541; 362/31, 223, 260, 217, 97, 225, 330, 317

[56] References Cited

U.S. PATENT DOCUMENTS

| | | | |
|---|---|---|---|
| D. 124,617 | 1/1941 | Strassburger et al. | 362/355 X |
| D. 127,394 | 5/1941 | Guth | 362/355 X |
| 1,570,345 | 1/1926 | Eliasoff | 362/355 |
| 1,718,155 | 6/1929 | Klehr | 362/347 |
| 1,858,755 | 5/1932 | Van Wyck et al. | 40/564 |
| 1,898,463 | 2/1933 | Nulsen | 40/576 |
| 1,904,192 | 4/1933 | Benson | 40/572 |
| 2,078,584 | 4/1937 | Pendelton | 40/545 |
| 2,106,891 | 2/1938 | Hammer | 40/463 |
| 2,109,643 | 3/1938 | Kehl | 40/576 |
| 2,269,278 | 1/1942 | Mackintosh et al. | 40/564 |
| 2,274,612 | 2/1942 | Johnston | 362/347 |
| 2,306,511 | 12/1942 | Wagner | 40/576 |
| 2,551,710 | 5/1951 | Slaughter | 362/355 |
| 2,588,545 | 3/1952 | Lawrence | 40/564 |
| 2,595,520 | 5/1962 | Guerin | 362/260 |
| 2,740,216 | 4/1956 | Lieberman | 362/355 X |
| 2,820,918 | 1/1958 | Aronstein | 362/260 X |
| 2,893,148 | 7/1959 | Figman | 40/576 |
| 2,996,821 | 8/1961 | Wayne | 40/573 |
| 3,016,454 | 1/1962 | Simms | 362/321 |
| 3,137,083 | 6/1964 | George et al. | 40/575 |
| 3,296,431 | 1/1967 | Green | 40/570 |
| 3,419,986 | 1/1969 | Maze | 40/564 |
| 3,597,868 | 8/1971 | Tamborello | 40/361 |
| 4,242,725 | 12/1980 | Douma et al. | 362/341 |
| 4,287,555 | 9/1981 | Stilling | 40/564 |
| 4,335,421 | 6/1982 | Modia et al. | 40/361 |
| 4,388,675 | 6/1983 | Lewin | 362/260 X |
| 4,393,323 | 7/1983 | Hübner | 362/248 |
| 4,418,378 | 11/1983 | Johnson | 362/248 |
| 4,432,044 | 2/1984 | Lautzenheiser | 362/323 |

FOREIGN PATENT DOCUMENTS

| | | | |
|---|---|---|---|
| 586155 | 11/1959 | Canada | 40/576 |

*Primary Examiner*—Kenneth J. Dorner
*Assistant Examiner*—J. Hakomaki
*Attorney, Agent, or Firm*—Eliot S. Gerber

[57] ABSTRACT

An illuminated sign system, e.g., an illuminated canopy or roof ridge for petrol stations and the like, comprising a trough with one or more electrical fluorescent tubes partially covered by a light shield having areas of differing light transmissivity, e.g., filters or translucent areas, with reflecting screens in oblique position in the rear, optionally colored to reflect light of one or more selected colors, and a front side of transparent weatherproof material covered with translucent colored indicia.

6 Claims, 3 Drawing Sheets

ILLUMINATED SIGN SYSTEM

This application is a continuation of U.S. Patent Application Ser. No. 739,935, filed May 31, 1985, entitled "Illuminated Sign System," now abandoned.

The present invention relates to an illuminated sign system, e.g., to an illuminated canopy or shelter ridge mainly to be used for the forecourt of petrol stations, and to an eave lath for indication purposes.

Light beacons and illuminated troughs in the form of eave laths made of glass or similar material in supporting profiles are already known, and illumination is provided in a conventional way by lamps. The following patents are representative of prior works in this field:

| U.S. Pat. No. | Applicant(s) | Issued |
|---|---|---|
| 918,701 | B. Roman | 04/20/09 |
| 1,721,700 | C. B. Lancaster | 07/23/29 |
| 1,740,736 | J. Hotchner | 12/24/29 |
| 2,699,620 | R. O. Smythe | 01/18/55 |
| 4,021,945 | A. Sussman | 05/10/77 |
| 4,034,494 | C. M. Lane | 07/12/77 |
| 4,114,299 | T. Brownlee | 09/19/78 |
| 4,126,855 | E. E. Alms et al | 11/21/78 |
| 4,185,408 | C. H. Tracy | 01/29/80 |
| 4,277,904 | F. W. Leuthesser | 07/14/81 |

A disadvantage of prior illuminated ridges or eave laths is that too much light is emitted, so that traffic may be impeded by extreme brightness or reflections in the case of a sign near a highway. If the light-intensity is decreased, however, the illumination may be insufficient. In addition, prior illuminated signs have suffered from non-uniform light distribution over the visible surface of the sign, as well as from high energy consumption.

These and other disadvantages are overcome by the present invention. As an example, a conventional sign system may require 200 Watts per meter; a sign in accordance with the present invention may use only 40 Watts per meter.

The present invention advantageously utilizes fluorescent tube lamps mounted in a trough. The fluorescent tubes are positioned adjacent U-shaped covers constituting light shields that are clamped onto the support of each tube. The light shields have areas thereof which differ in light transmissivity. Light reflecting surfaces may be mounted in the rear of the trough.

The light shield material is preferably polycarbonate (e.g., "Makrolon") which is sufficiently resistant to temperature changes and to deleterious environmental conditions. The front side of the trough is preferably closed by shields of weatherproof polymethylmetacrylate (e.g., "Plexiglas" or "Perspex"). The front side of the illuminated trough can be provided with colored indications or with color planes of translucent adhesive film with an adhesive layer, which results in a very strong attachment (e.g., "Scotchlite") with a matte surface, to provide an illuminated sign.

The intensity of colored light permitted in accordance with applicable regulations generally depends upon the color or wavelength. For example, yellow light may yield up to 350 Lux, but red light only to 35 Lux. The present invention permits the selective variation of light onto different portions of an illuminated facia of a sign.

Blue light may be used to "whiten" parts of the illuminated sign. Thus selected areas of the light shield may constitute filters responsive to light of preselected wavelength, e.g., blue filters, opaque or light-blocking filters, etc. The reflecting surface preferably consists of several flat parts of smooth rectangular white material, such as white coated metal or impact-resistant plastic, which may be colored as desired to reflect light of selected colors, e.g., blue light to "whiten".

In accordance with the light intensities and luminosity desired, a light shield is combined with one or more reflecting surfaces, as necessary, to provide an appropriate intensity and distribution of light for illuminating a sign. Preferably the shield is U-shaped, with the open part of the U facing the fluorescent tube. The shield may be of flexible material, normally flat, which is bent by hand and then positioned in a supporting frame constituting a part of the trough so as to hold the shield in its U-shaped form. That shield may be formed with one or more strips of translucent material parallel to the longitudinal axis of the fluorescent tube and used to modify the light directed onto the facia. By selectively blocking the light transmitted by the fluorescent tube and selectively reflecting that light, a uniform distribution of light intensity may be achieved, as desired, as well as a non-uniform distribution, as desired, in selected applications. In essence, total control of the light in the sign is achieved by the novel light shield alone or in combination with reflecting surfaces so that light may be controlled throughout all areas of the sign.

The invention will be more completely understood by reference to the following detailed description of a presently preferred embodiment thereof. In the attached drawings, FIG. 1 is a transverse sectional view of a presently preferred lamp and shield and reflector combination embodying the present invention.

Figure 1:
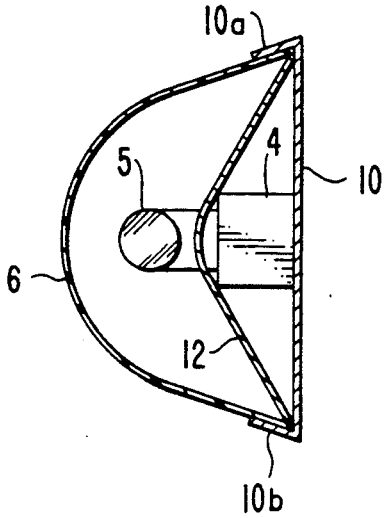

Referring to FIG. 1, a holder 4 for supporting a tubular fluorescent lamp 5 is mounted on a support 10. A reflector 12 is also mounted by the holder 4 and support 10 to direct light outwardly from the lamp 5. A light shield 6 is held by the support 10, and preferably is made of flexible material, such as plastic, which is normally flat but which may be bent in a general U-shape to the configuration shown in FIG. 1, with its longitudinal edges positioned inside longitudinal edges 10*a* and 10*b* of the support 10 which holds the light shield 6 in place. The light shield 6 includes areas thereof which differ in light transmissivity, as will be explained in more detail below, so as selectively to permit light from the lamp 5 to pass outwardly from the assembly of FIG. 1.

Figure 2:
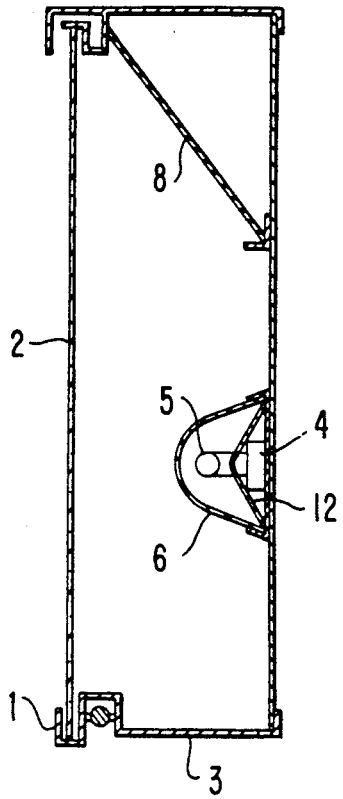
FIGS. 2 to 4 are transverse sectional views of signs incorporating the assembly of FIG. 1.
Figure 3:
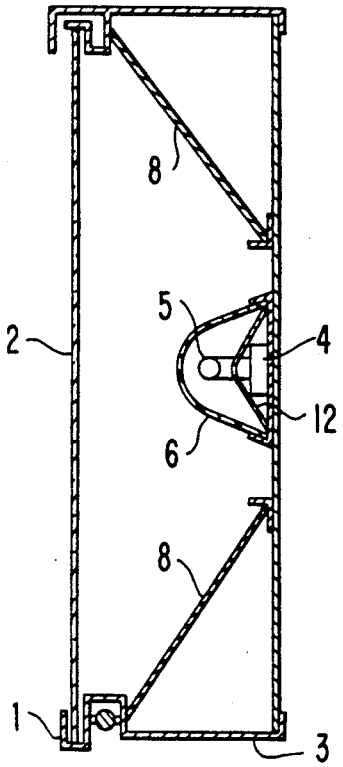
Figure 4:
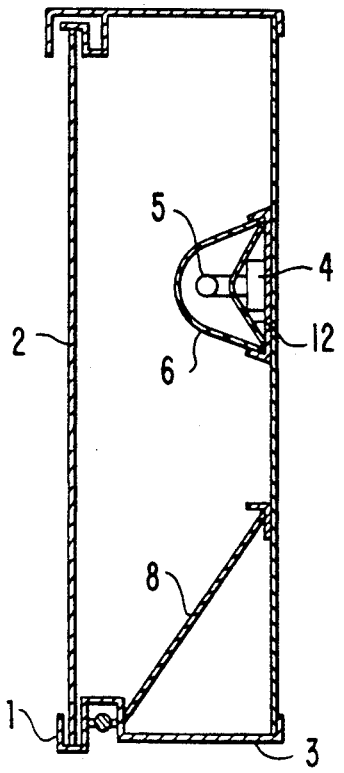

As shown in FIGS. 2 to 4, the assembly of FIG. 1 is mounted in a trough 3 which is generally rectangular in section. The front of the trough 3, as at 1, may be profiled for the support of a facia of the sign which is typically of translucent or transparent material, weatherproof, containing indicia or colors thereon which are to be illuminated by the lamp 5. FIG. 2 shows a single reflector 8 positioned in the upper portion of the trough for reflection of light principally onto the upper portion of the facia 2. FIG. 3 shows two of such reflectors 8, positioned at the top and bottom of the trough, for reflecting light principally to the upper and lower portions of the facia 2. FIG. 4 shows a single reflector 8 positioned at the bottom of the trough, principally for directing light to the lower portion of the facia 2.

Figure 5:
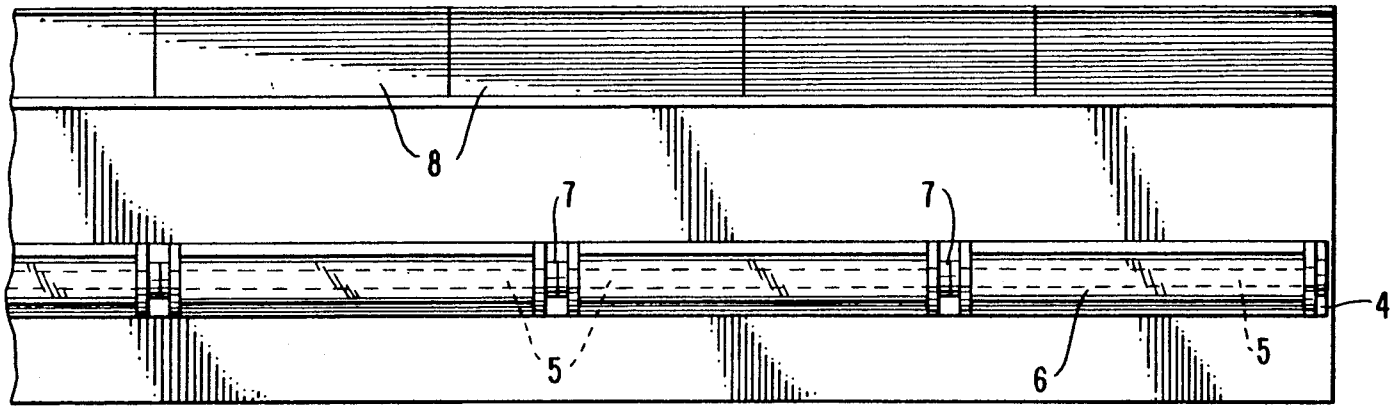
FIG. 5 is a view essentially constituting a horizontal section of a part of one of the signs of FIGS. 2 to 4, to an enlarged scale, showing a series of assemblies as in FIG. 1, positioned end-to-end.

FIG. 5 shows an end-to-end positioning of various assemblies as in FIG. 1. There are a plurality of fluorescent tubes 5 positioned end-to-end. The numeral 7 designates the region between adjacent tubes. It should be noted that the ends of a fluorescent tube normally darken as the tube ages, and the light output from the end regions diminishes. For this reason, the shield 6 may be cut-away or diminished in the region of the ends of the fluorescent tubes to permit more light to pass from the tube, compensating for the decreased light output from the darkened tube end.

Figure 6:
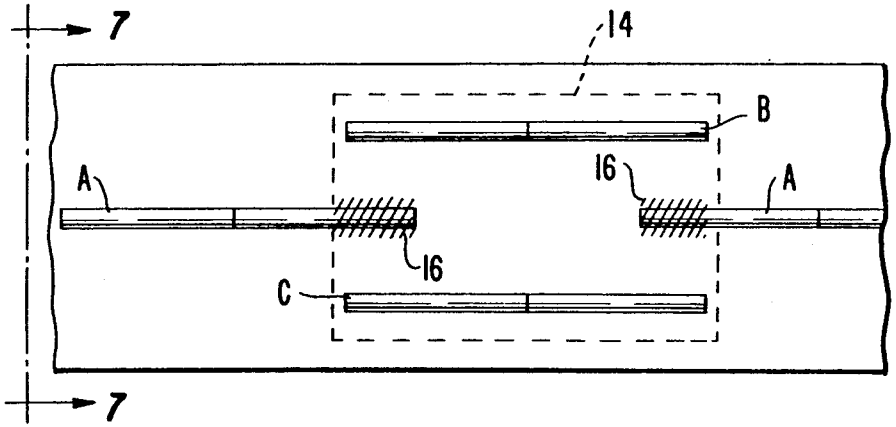
FIG. 6 is a schematic representation of assemblies as in FIG. 1 positioned to provide varying light output for an illuminated sign.

FIG. 6 shows a representative arrangement of tubes in which enhanced or increased light output is desired in the dashed section 14. The assemblies are denoted A, B, and C in FIG. 6, and the same notation is used in FIG. 7.

It will be noted that the assemblies A are linearly positioned in the central region of the lighting fixture, while the assemblies B and C are linearly positioned respectively in the upper and lower regions of the sign. There is an overlap of the assemblies A, B and C as designated by the lines 16 in FIG. 6. Any undesired increase in light output because of such overlapping may be overcome by use of the light shields 6, as described in more detail below.

Figure 7:
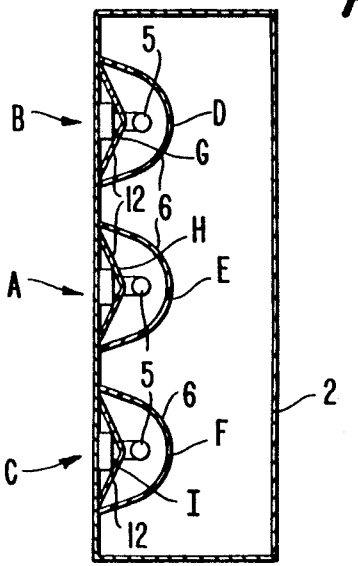
FIG. 7 is a sectional view, to an enlarged scale, looking in the direction of arrows 7—7 in FIG. 6.
Figure 8:
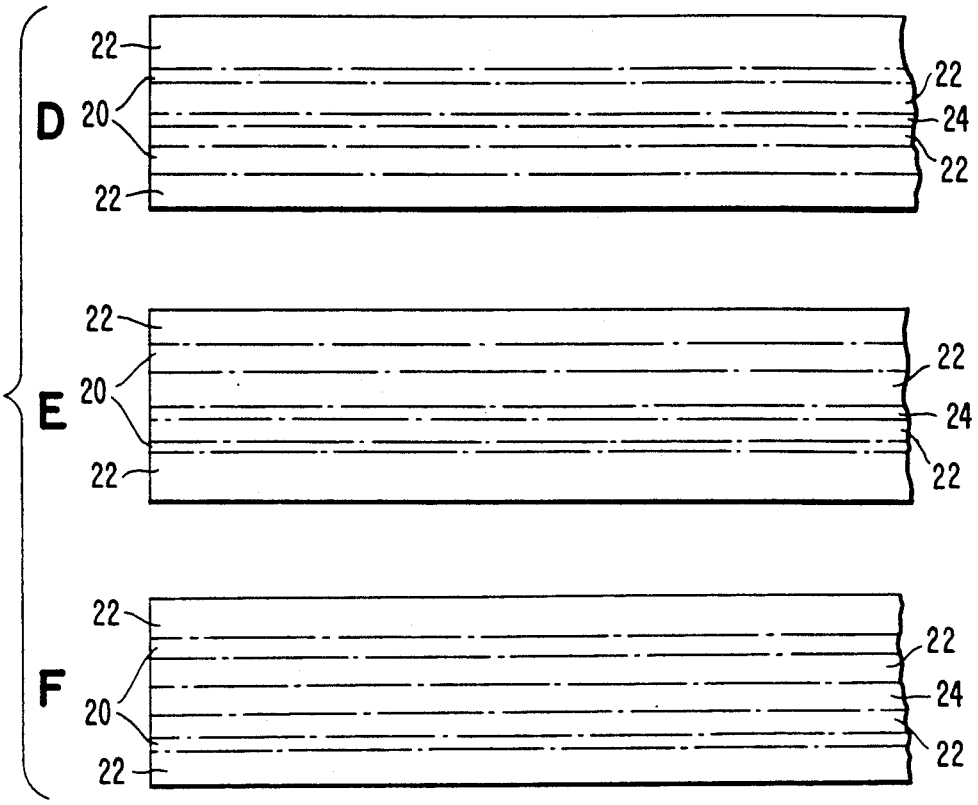
FIG. 8 shows representative light shields used in the system of FIGS. 6 and 7 (flat planar layouts).
Figure 9:
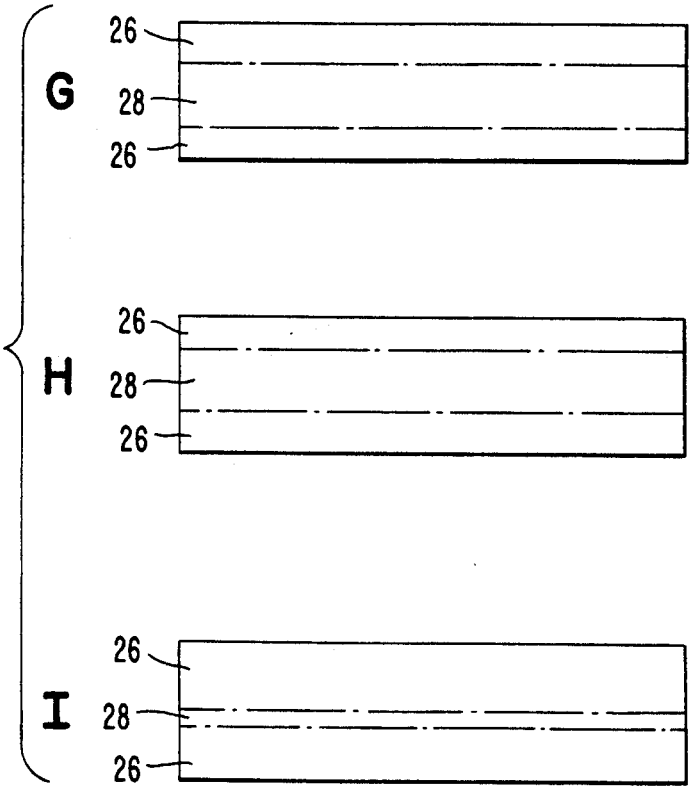
FIG. 9 shows representative reflectors used in the system of FIGS. 6 and 7 (flat planar layouts).

With reference to FIG. 7, the upper, middle and lower light shields 6 have been designated respectively as D, E, and F. Similarly, the upper and middle and lower reflectors 12 have been designated respectively as G, H, and I. FIG. 8 shows representative light shields or filters D, E, and F, while FIG. 9 shows representative reflectors G, H, and I. With reference to FIG. 8, each of the light shields may be transparent in the regions 20, while a white translucent film may be used on the light shield in the regions 22. A blue translucent film may be used on the shield in the regions 24. The use of blue translucent film has the effect of "whitening" the display in the facia 2 of the sign.

With reference to FIG. 9, the reflectors 12 may be similarly colored blue, as indicated by the numeral 26, for "whitening" of the light. Normally, the reflectors would be white, as indicated by the regions 28.

The lighting assemblies described above are very versatile in providing light of selected color and intensity in selected areas of a sign. By using translucent or opaque films on a light shield, light may be selectively blocked from fluorescent lamps so as to direct it selectively in the device. The shields in combination with reflectors 12 and 8 may be used, in varying combinations, to intensify or reduce light in selected regions to achieve the desired effect. The assembly is very versatile, inasmuch as different light shields may easily be substituted, one for the other, since each shield is held simply in place by the support 10 as shown in FIG. 1. For this purpose, the facia 2 of the sign is advantageously supported at the front of the sign for easy installation and removal. Thus reflectors 8 may be added or substracted as in FIGS. 2 to 4 for varying effects. The position of the FIG. 1 assembly within the overall trough may be used to vary the distribution of light output. For example, note in FIG. 2 how that assembly is positioned in the lower half of the trough, while the assembly in FIGS. 3 and 4 is positioned in the middle of the trough.

Tests have shown that uniform light output throughout the sign may be achieved through various combinations of elements as described above. The U-shaped light shield, with its selective light transmissivity in varying regions directly provided by light-modifying strips extending parallel to the axis of the fluorescent lamp, has been proven to be very effective in controlling light output. By providing light filtering in that shield as through the use of differently colored filters, enhanced light output may be achieved.

It will be appreciated that modifications may be made in the above preferred embodiment. While a backlighted sign has been disclosed, a double-faced sign is possible involving, for example, a single lamp, two opposed shields on opposite sides thereof, and opposed facia outside of the shields. These and other modifications will suggest themselves to persons skilled in the art. Accordingly, the invention should be taken to be defined by the following claims.

I claim:

1. An illuminated sign assembly having a housing and a sign mounted therein, the sign including a face plate with indicia thereon, said sign assembly including, within said housing, an elongated tubular fluorescent lamp for generating light output for illuminating the sign face plate from the rear, the improvement comprising a light shield interposed between said lamp and said face plate, in which said shield extends generally along the length of said lamp and is U-shaped in transverse section with the open part of the U-shape being directed toward said tubular lamp, said shield being especially adapted to illuminate the indicia on the face plate, said shield including a plurality of translucent strips extending generally parallel to each other and to the axis of said tubular lamp, which strips differ in light transmissivity from the non-strip portion of said shield to provide selected elongated horizontal illuminated areas on said face plate, which selected horizontal areas differ in illumination on said face plate.

2. An illuminated sign assembly having a housing and a sign mounted therein, the sign including a face plate with indicia thereon, said sign assembly including, within said housing, an elongated tubular fluorescent lamp for generating light output for illuminating the face plate from the rear, the improvement comprising a light shield interposed between said lamp and said face plate, in which said shield extends generally along the length of said lamp and is curved in transverse section with the open part of the curve being directed toward said tubular lamp, said shield being especially adapted to illuminate the indicia on the face plate, said shield including a plurality of translucent strips extending generally parallel to each other and to the axis of said tubular lamp which strips differ in light transmissivity from the non-strip portion of said shield to provide selected elongated horizontal illuminated areas on said face plate, which selected horizontal areas differ in illumination on said face plate.

3. A light source according to claims 1 or 2 in which certain of said strips constitute filters responsive to light of preselected wavelength.

4. A light source according to claims 1 or 2 in which the ends of said lamp are open and unshielded.

5. A light source according to any one of claims 1, including a reflector positioned behind said lamp for reflecting light from said lamp toward said sign.

6. A light source according to claim 5, in which selected areas of said reflector are colored to reflect light of one or more selected colors toward said shield.

* * * * *